US010167688B2

(12) United States Patent
Jelgert et al.

(10) Patent No.: US 10,167,688 B2
(45) Date of Patent: Jan. 1, 2019

(54) METHOD OF DISCONNECTING A DRILL STRING AT A DRILL RIG

(71) Applicant: SANDVIK INTELLECTUAL PROPERTY AB, Sandviken (SE)

(72) Inventors: Johan Jelgert, Lindesberg (SE); Lars-Erik Larsson, Nora (SE); Per Vilen, Nora (SE); Kent Evermark, Karlstad (SE)

(73) Assignee: SANDVIK INTELLECTIAL PROPERTY AB, Sandviken (SE)

( * ) Notice: Subject to any disclaimer, the term of this patent is extended or adjusted under 35 U.S.C. 154(b) by 0 days.

(21) Appl. No.: 14/891,602

(22) PCT Filed: Apr. 9, 2014

(86) PCT No.: PCT/EP2014/057157
§ 371 (c)(1),
(2) Date: Nov. 16, 2015

(87) PCT Pub. No.: WO2014/183931
PCT Pub. Date: Nov. 20, 2014

(65) Prior Publication Data

US 2016/0097245 A1 Apr. 7, 2016

(30) Foreign Application Priority Data

May 17, 2013 (EP) ..... 13168189

(51) Int. Cl.

| | |
|---|---|
| ***E21B 19/16*** | (2006.01) |
| ***E21B 19/10*** | (2006.01) |
| ***E21B 19/07*** | (2006.01) |
| ***E21B 19/20*** | (2006.01) |
| ***E21B 3/02*** | (2006.01) |
| ***E21B 7/04*** | (2006.01) |
| ***E21B 17/00*** | (2006.01) |

(Continued)

(52) U.S. Cl.
CPC ..... *E21B 19/161* (2013.01); *E21B 7/02* (2013.01); *E21B 19/16* (2013.01); *E21B 19/165* (2013.01); *E21B 19/20* (2013.01)

(58) Field of Classification Search
None
See application file for complete search history.

(56) References Cited

U.S. PATENT DOCUMENTS

| | | | | |
|---|---|---|---|---|
| 3,043,619 | A | 7/1962 | George et al. | |
| 4,604,724 | A | 8/1986 | Shaginian et al. | |
| 6,179,065 | B1 * | 1/2001 | Payne | E21B 19/15 175/24 |
| 6,481,930 | B2 * | 11/2002 | Forrest | F16L 55/1657 173/147 |

(Continued)

FOREIGN PATENT DOCUMENTS

| | | | |
|---|---|---|---|
| CN | 202673199 | U | 1/2013 |
| WO | 2008028302 | A1 | 3/2008 |

(Continued)

*Primary Examiner* — Matthew R Buck
*Assistant Examiner* — Douglas S Wood
(74) *Attorney, Agent, or Firm* — Corinne R. Gorski

(57) ABSTRACT

A method and apparatus for disconnecting an end rod from a drill string coupled together by a threaded connection is provided. A rod handling apparatus includes a gripper unit having a floating sled with a sensor unit configured to monitor relative axial position of the sled relative to a frame of the gripper unit to determine a decoupling of the threaded connection and a separation of an end rod from the drill string.

13 Claims, 8 Drawing Sheets

(51) Int. Cl.

| | |
|---|---|
| ***B25B 17/00*** | (2006.01) |
| ***E21B 19/08*** | (2006.01) |
| ***E21B 7/02*** | (2006.01) |

(56) References Cited

U.S. PATENT DOCUMENTS

| | | | | |
|---|---|---|---|---|
| 6,634,443 | B1 * | 10/2003 | Paech | E21B 15/04 175/85 |
| 6,845,825 | B2 * | 1/2005 | Bischel | E21B 19/20 173/176 |
| 7,000,502 | B2 * | 2/2006 | Belik | E21B 19/161 81/57.2 |
| 7,882,902 | B2 | 2/2011 | Boutwell | |
| 8,601,910 | B2 * | 12/2013 | Begnaud | E21B 19/168 166/77.51 |
| 9,303,472 | B2 * | 4/2016 | Ellis | E21B 19/07 |
| 2004/0174163 | A1 | 9/2004 | Rogers et al. | |
| 2004/0223533 | A1 | 11/2004 | Dishaw et al. | |
| 2005/0056122 | A1 | 3/2005 | Belik | |
| 2005/0076744 | A1 * | 4/2005 | Pietras | E21B 19/163 81/57.16 |
| 2010/0132180 | A1 | 6/2010 | Conquergood et al. | |
| 2012/0213937 | A1 | 8/2012 | Lavalley et al. | |
| 2012/0273230 | A1 | 11/2012 | Patterson et al. | |
| 2012/0297933 | A1 | 11/2012 | Kay et al. | |

FOREIGN PATENT DOCUMENTS

| | | | |
|---|---|---|---|
| WO | 2011129760 | A1 | 10/2011 |
| WO | 2012162617 | A2 | 11/2012 |

* cited by examiner

METHOD OF DISCONNECTING A DRILL STRING AT A DRILL RIG

RELATED APPLICATION DATA

This application is a § 371 National Stage Application of PCT International Application No. PCT/EP2014/057157 filed Apr. 9, 2014 claiming priority of EP Application No. 13168189.2, filed May 17, 2013.

FIELD OF INVENTION

The present invention relates to drill rod handling apparatus and a method of decoupling rods of a drill string.

BACKGROUND ART

Exploration drilling typically involves drilling to subterranean depths of thousands of meters. Accordingly, it is necessary to join and install successive sections of pipe or rod as the drill string is advanced into the well.

Drill rod, depending on their specific configuration, may weigh between ten to twenty kilograms each and measure approximately two to three meters in length. Conventionally, the drill rods are interconnected by male and female threaded connections provided at the respective rod ends. Additionally, it is typically unavoidable to have to exchange the drill bit or other tools at the lowermost end of the drill string at regular intervals during drilling. This exchange process involves retrieving the entire drill string from the borehole, exchanging the lowermost portion and then reinstalling the entire drill string after which drilling may continue. In practice, and depending upon rock conditions, it is not uncommon for ten to twenty retrieval operations to be undertaken per drill hole. Accordingly, a very large number of drill rods are required to be handled and in particular taken from a transport or carriage carrier to the drilling rig where they are ready for axial alignment and coupling to the drill string. Of course, the reverse operation is also required during string retrieval. Example rod handling systems are disclosed in U.S. Pat. No. 3,043,619; GB 2334270; WO 00/65193; and WO 2011/129760.

A Rod Handling System may typically comprise a robot arm having a dedicated gripper for gripping the drill rods. During a forward drilling operation, the robotic arm is arranged to pick up drill rods at a transport or intermediate carrier and to place the drill rod in the drill rig, whereupon the drill rod is connected to an already installed drill rod to extend the drill string. During a drill string retrieval operation, the robotic arm is arranged to pick up disconnected rods from the drill rig and to replace them onto the transport or intermediate carrier.

In order to provide a fully automatic system, that eliminates the need for regular manual intervention, it is desirable for the rod handling system to be able to connect and disconnect the drill rod to/from the installed drill rods.

Conventionally, when a gripper unthreads a rod from the drill string ready for transport to a storage position, there is no exact method of detecting when the rod in the gripper is released from the string and in particular the complete disconnection of the threaded end. Some examples of attempts to solve this problem are disclosed in GB 2443955; US 2004/0223533; US 2009/0056467; US 2004/0174163; US 2010/0132180; WO 2008/028302; WO 2005/033468 and US 2012/0273230. Accordingly, there is a need for a rod handling system for disconnecting drill rods that addresses the above problems.

SUMMARY OF THE INVENTION

It is an objective of the present invention to provide apparatus and a method for the efficient and reliable decoupling of rods of a drill string at a drill rig. It is a further specific objective to provide means for identifying and reliably controlled release of threaded connections of the drill string rods to enable an end rod to be transported from the drill rig to a storage location. It is a further objective to provide a method and a sequence of steps for the controlled decoupling of the threaded connections to determine precisely when an end rod has been fully decoupled.

The objectives are achieved by providing a rod handling apparatus and a drill rig that are operative according to a decoupling method to allow sensing and detecting of relative axial movement of the end rod of the drill string to identify precisely the moment when the end rod is decoupled and available for transport. According to the present apparatus and method, a time and energy efficient process is provided that avoids undesirable interruptions in the retraction process of the drill string from the borehole. In particular, the objectives are achieved by providing a rod handling apparatus having a gripping unit in which a sled is mounted in an axially 'floating' configuration at a gripper frame whereby an axial sliding movement of the sled is monitored by at least one sensor arrangement. Engagers at the sled contact and hold an end rod of the drill string such that the end rod is also suspended in 'floating' relationship relative to the gripper frame.

According to a first aspect of the present invention there is provided a method of disconnecting an end rod from a drill string coupled together by a threaded connection, the method comprising: initially rotating the end rod relative to the remaining drill string in a disengagement direction of the threaded connection to partially disconnect the end rod from the drill string; moving a gripper unit into engagement with the partially disconnected end rod, the gripper unit having a frame and a sled suspended at the frame to be axially slidable relative to the frame, the sled having rod engagers to engage and hold the end rod; characterised by: further rotating the end rod in the disengagement direction via the rod engagers to further decouple the end rod from the drill string; and monitoring a relative axial position of the sled at the frame using at least one sensor to determine a decoupling of the threaded connection and a decoupling of the end rod from the drill string.

Preferably, the method comprises axially biasing the sled at the frame via at least one bias component to provide resistance to axially forward (F) or rearward (R) movement of the sled relative to the frame.

Optionally, and according to one implementation, the method comprises moving the frame axially rearward (R) away from the drill string whilst the sled is substantially stationary and in engagement with the end rod to bias the frame against the sled prior to the step of further rotating the end rod; and following the step of further rotating the end rod moving the frame axially rearward (R) from the drill string whilst monitoring the axial position of the sled at the frame.

Optionally, and according to a specific implementation, the method further comprises moving the frame axially rearward (R) away from the drill string whilst the sled is substantially stationary and in engagement with the end rod to bias the frame against the sled prior to the step of further rotating the end rod; and during the step of further rotating the end rod moving the frame axially rearward (R) from the drill string whilst monitoring the axial position of the sled at the frame.

Optionally, and according to a specific implementation, the method comprises moving the frame axially rearward (R) away from the drill string whilst the sled is substantially stationary and in engagement with the end rod to bias the frame against the sled prior to the step of further rotating the end rod; and wherein the step of monitoring the relative axial position of the sled at the frame comprises identifying an axial movement direction change of the sled relative to the frame corresponding to a change in the axial movement direction of the end rod relative to the drill string being associated with a decoupling of the threaded connection.

Optionally, the step of further rotating the end rod comprises maintaining the axial position of the frame to bias the sled against the frame as the end rod is moved axially rearward from the drill string; and wherein the step of monitoring the relative axial position of the sled and frame comprises identifying an axial movement direction change of the sled relative to the frame corresponding to a change in the axial movement direction of the end rod relative to the drill string being associated with a decoupling of the threaded connection.

Preferably, the method comprises biasing the sled at the frame using at least one first bias component to be resistant to axial forward movement (F) of the sled relative to the frame and at least one second bias component to be resistant to axial rearward movement (R) of the sled relative to the frame, the axial forward (F) and rearward (R) movement being relative to the drill string. Preferably, the first and second bias components comprise coiled springs mounted about one of a pair of rails extending between regions of the gripper frame and upon which the sled is slidably mounted. Preferably, the rails comprise elongate rods extending side-by-side and parallel to one another with a first pair of springs provided at first respective ends and a second pair of springs provided at a respective second end. Preferably, the sled comprises a pair of sleeves or rail engagers to allow sliding movement axially along the rails between the end springs.

Preferably, the method comprises gripping and holding the end rod at the sled via rod engaging jaws that close around the end rod. Preferably, the engaging jaws are mounted at the gripper units to move in a sideways lateral direction in a plane transverse to the longitudinal axis of the end rod. Preferably, the engaging jaws move substantially linearly along an axis perpendicular to the longitudinal axis. Optionally, the engaging jaws may be pivotally mounted at the gripper unit so as to pivot in a plane orientated perpendicular to the longitudinal axis.

Optionally, the step of further rotating the end rod comprises driving a rotation of the end rod using at least one rotatable member provided at the rod engagers positioned in frictional engagement with the end rod.

Optionally, the step of initially rotating the end rod comprises gripping the drill string with a rod holder of the drill rig axially forward of the threaded connection; and rotating the end rod at a region axially rearward of the threaded connection using a rotation unit of the drill rig.

Optionally, the step of monitoring the relative axial position of the sled at the frame comprises monitoring and/or detecting an axial movement (F, R) between a region of the frame and a region of the sled. Optionally, the sensor is mounted at the sled or the frame and configured to monitor movement of a region of the alternate frame or sled. Accordingly, the sensor may comprise two or more parts with the first part mounted at the sled and the second part mounted at the frame. Optionally, the sensor or sensor arrangement may comprise any one or a combination of the following set of: an optical sensor; a laser; a camera; a pressure sensor configured to identify changes in hydraulic or pneumatic pressures associated with hydraulic or pneumatic means associated with the frame and/or sled; an accelerometer; a sound sensor; an electronic based sensor; an electric based sensor; a magnetic based sensor.

According to a second aspect of the present invention there is provided drill rod handling apparatus cooperative with a drill rig to a rod to and from a drill string created by the drill rig, the apparatus comprising: a gripper frame; a sled mounted at the frame via at least one runner to be capable of sliding movement relative to the frame in an axial direction of the rod to be transported by the apparatus; a bias component to bias the axial sliding movement of the sled relative to the frame; rod engagers mounted at the sled to engage and hold the rod to be transported; a sensor positioned at the sled or frame configured to monitor a relative axial position of the sled relative to the frame; characterised in that the bias component comprises: at least one first bias component positioned to bias the sled to be resistant to an axially forward movement (F) of the sled along the at least one runner; and at least one second bias component positioned to bias the sled to be resistant to an axially rearward movement (R) of the sled along the at least one runner.

Preferably, the apparatus comprises two runners positioned parallel to one another; and a pair of first bias components, each first bias component mounted respectively towards a first end of each runner and a pair of second bias components mounted respectively towards a second end of each runner. Preferably, each of the two runners comprises rods extending between regions of the gripper frame and the sled comprises runner guides to allow the sled to slide on the runners between the regions of the gripper frame.

BRIEF DESCRIPTION OF DRAWINGS

A specific implementation of the present invention will now be described, by way of example only, and with reference to the accompanying drawings in which.

DETAILED DESCRIPTION OF PREFERRED EMBODIMENT OF THE INVENTION

When a drilling section is complete, all the rods of the string have to be retracted out of the drill hole one at a time.

A rotation unit of the drill rig is the unit that initially 'cracks open' the threaded connections between the rods since this requires a large torque. After the end joint is cracked, the rotation unit is moved to a forward most position of the rig to allow substantially the entire length of rearward most rod the string to become available to be contacted by a gripper unit that completes the unthreading from the string for subsequent transport to a storage location.

The present rod handling apparatus is configured specifically for rod 'break-out' verification and in particular for detecting when a rod held be the gripper unit is released from the remaining rods of the string involving complete disconnection of the threaded ends. The present rod handling apparatus comprises mechanical and hydraulic components to provide a robust configuration given the rough working environments in which the present apparatus is operational.

Figure 1:
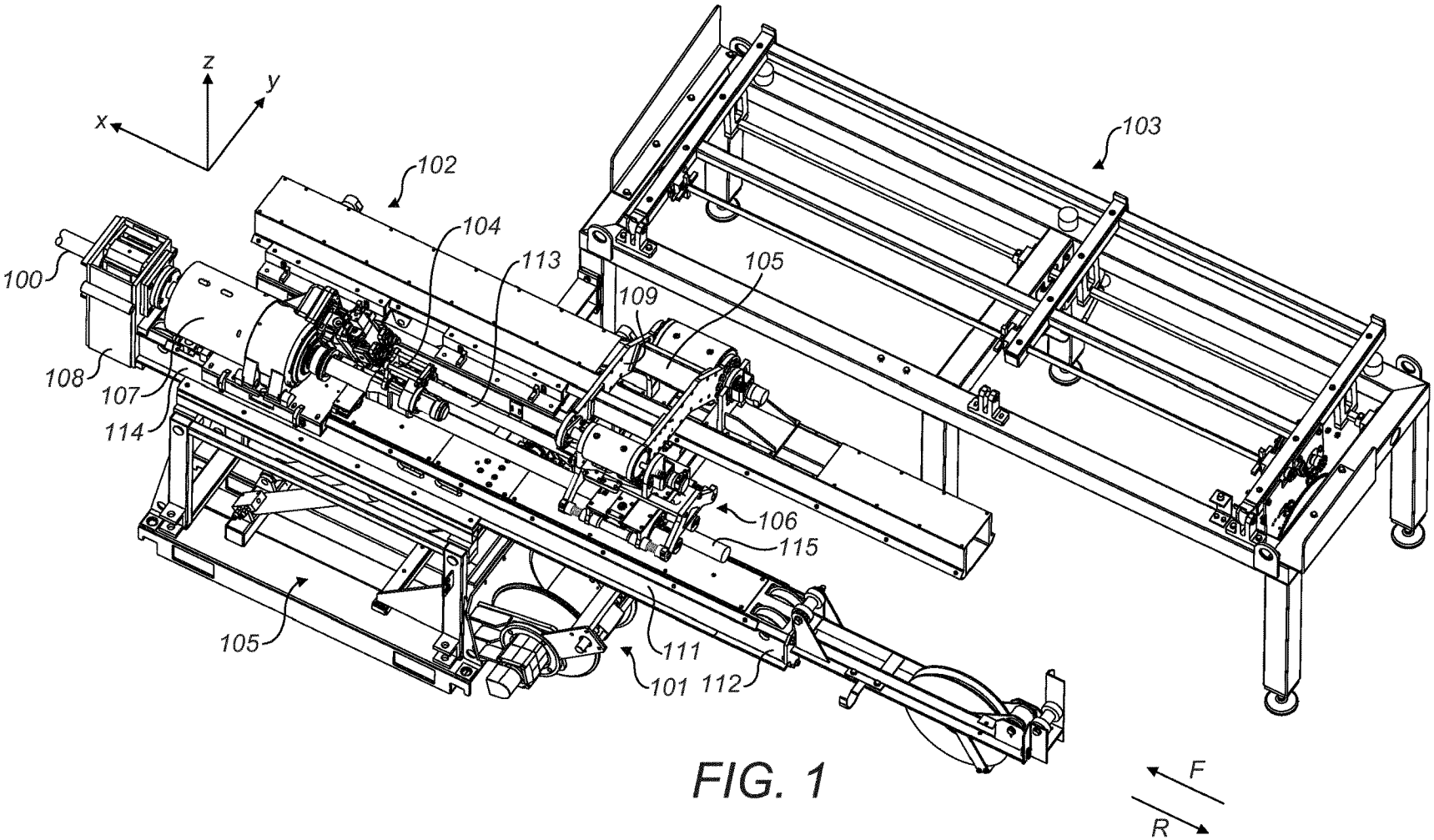
FIG. 1 is an upper perspective view of drill rig, a rod storage rack and rod handling apparatus positioned intermediate the drill rig and rack according to a specific implementation of the present invention.

Referring to FIG. 1, a drill rig 101 comprises a feed frame 111 having a first forward end 114 and a second rearward end 112 relative to a drill string. A rod holder 108 is mounted at first end 114 and is configured to hold an end rod 100 of the drill string that typically extends in a downward direction within a deep borehole. A rotation unit 107 is mounted behind holder 108 at frame 111 and comprises conventional components configured to rotate the drill string rods 100 during a drilling procedure. Feed frame 111 is mounted upon a ramp assembly 105 configured to adjust the drilling angle of rig 101. As illustrated, the drill string 100 extends in the x axis in which a rod drilling operation involves rotational advancement of the drill rods 100 in direction F whilst retraction of the rods from the borehole is undertaken in the opposite direction R both in the x axis.

Figure 2:
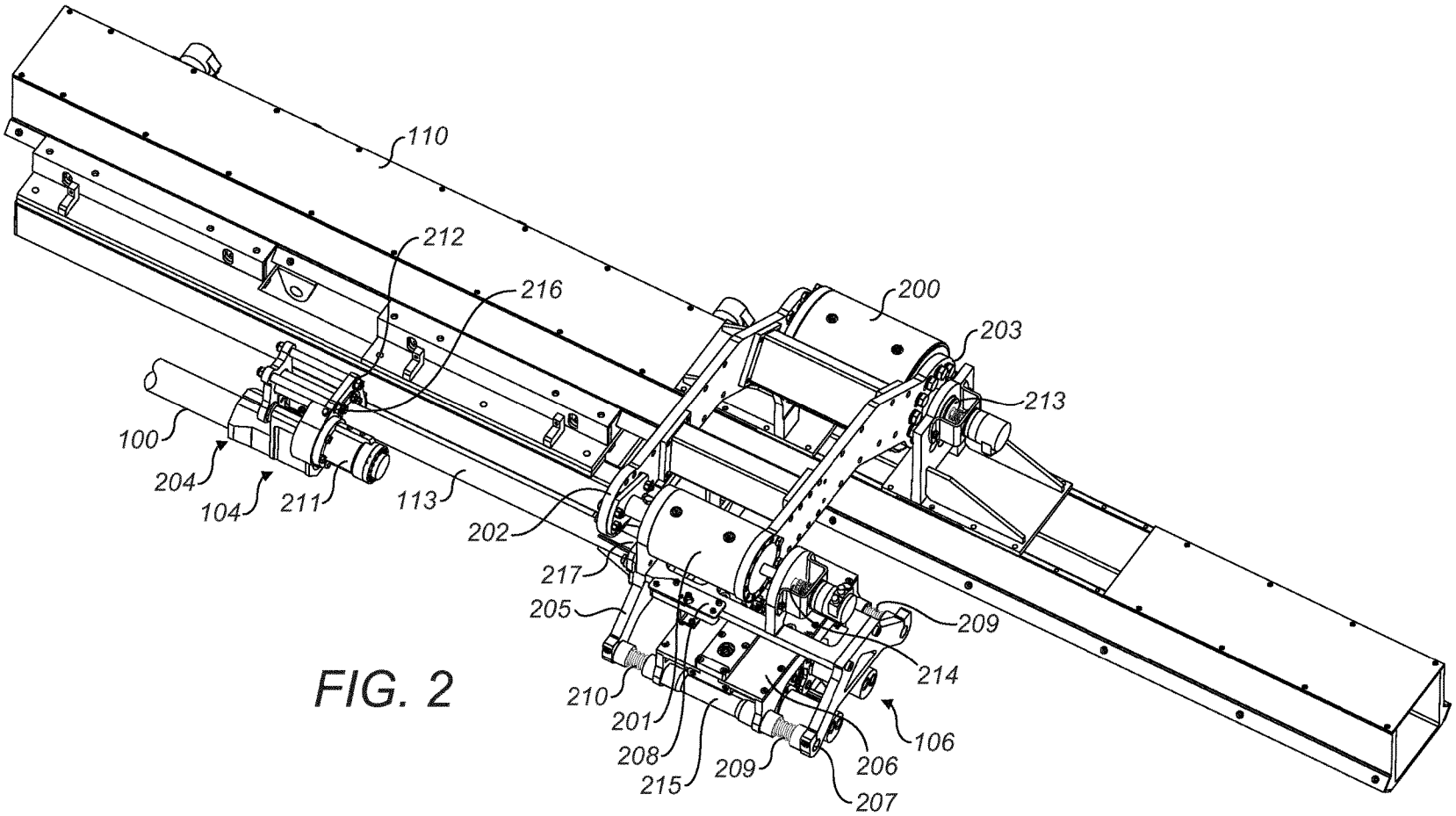
FIG. 2 is a first side perspective view of the rod handling apparatus of FIG. 1.

Rods to be supplied to drill rig 101 are transported and stored temporarily on a rod storage rack 103 positioned adjacent rig 101. Rod handling apparatus indicated generally by reference 102 is positioned intermediate rack 103 and rig 101 and is configured to transport rods between rack 103 and rig 101 during any drilling and retraction procedure. Referring to FIGS. 1 and 2, rod handling apparatus 102 comprises a guide frame 110 that mounts a transport unit in the form of a robotic arm 109 pivotally mounted at both its ends. A gripper unit 106 is mounted at one end of arm 109 and is configured to engage and hold rods to be transported between rack 103 and rig 101. To ensure rods are coupled efficiently and to avoid misalignment and damage during coupling, rod handling apparatus 102 further comprises an alignment tool 104 intended to engage an end rod of the drill string 100 and to mate the drill string with a 'transported' rod taken from rack 103.

Figure 3:
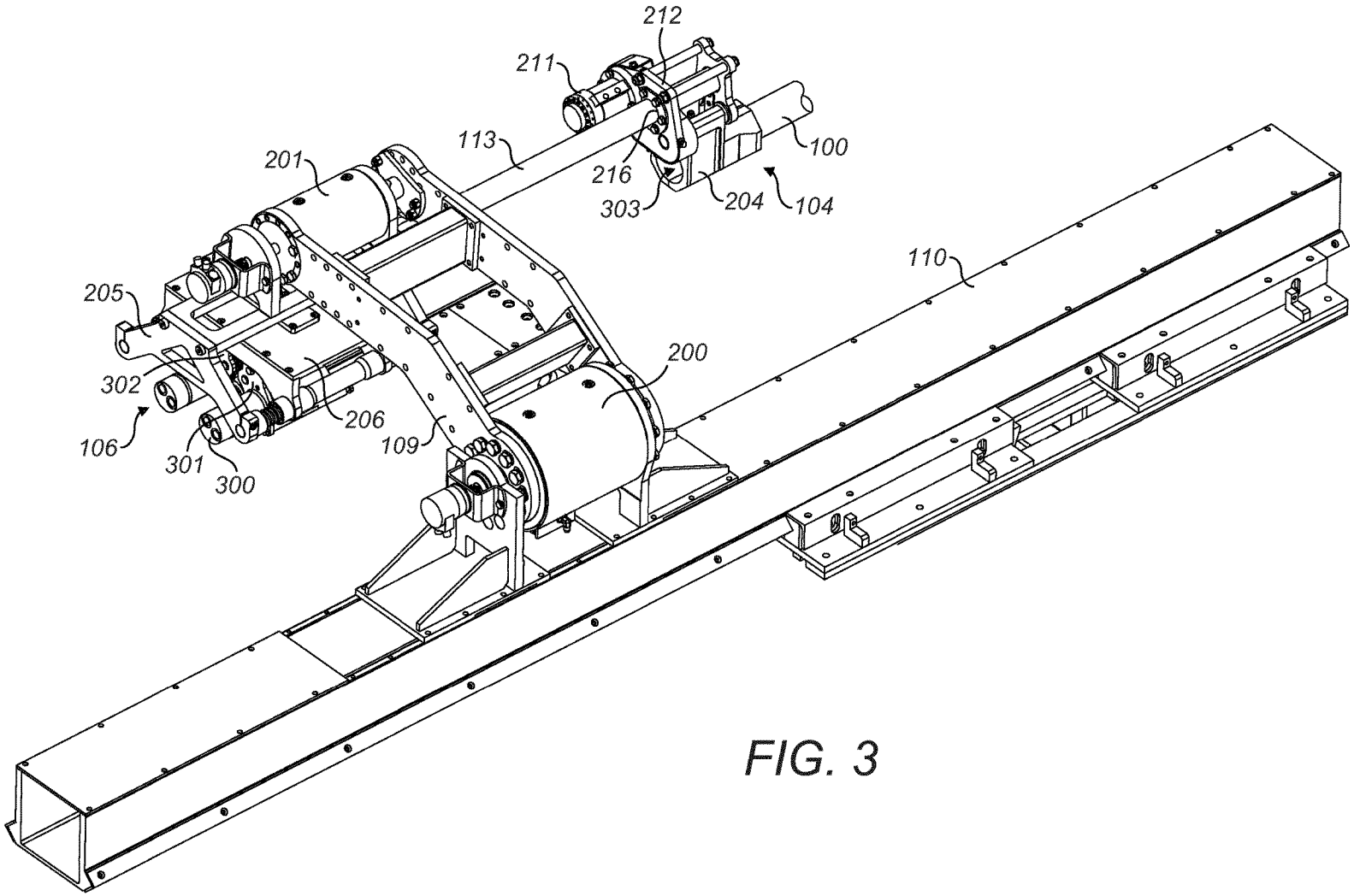
FIG. 3 is a second side perspective view of the rod handling apparatus of FIG. 2.
Figure 4:
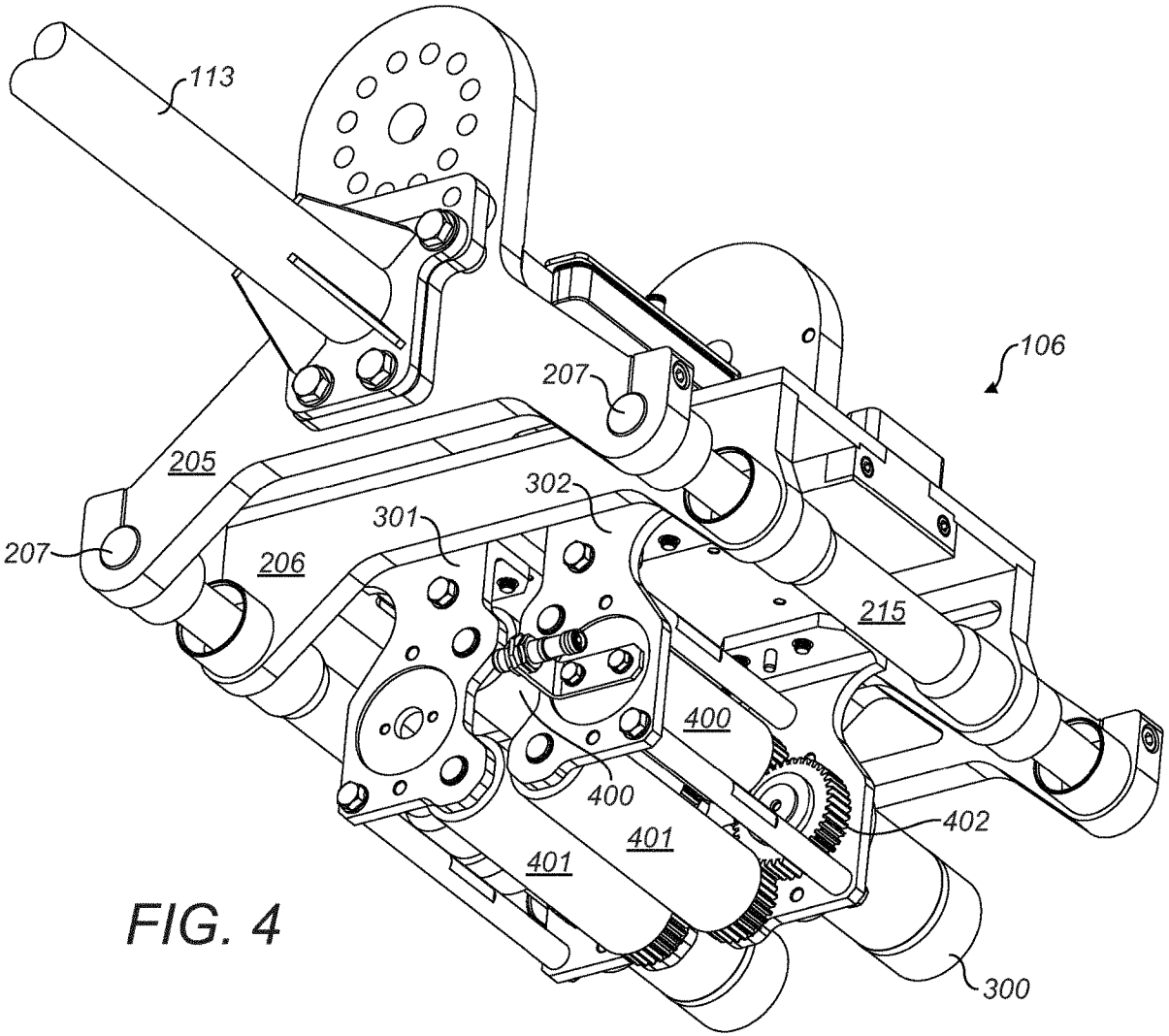
FIG. 4 is a lower perspective view of a rear part of the rod handling apparatus of FIG. 3.

Referring to FIGS. 2 to 4 actuating arm 109 is mounted at a first end 203 to guide frame 110 via an actuator 200 (being typically a hydraulic, pneumatic or electric motor) to provide pivoting rotation of arm 109 about a pivot axis 213. Gripper unit 106 is mounted at a second end 202 of arm 109. A corresponding actuator 201 is positioned at end 202 to drive rotational mounting of gripper unit 106 at arm 109 to be rotatable about a pivot axis 214. Additionally, drive and movement means (not shown) are provided such that arm 109 is capable of linear translation along the direction of frame 110 to adjust the relative position of the rod during transport to rig 101 in the x axis direction both during coupling and decoupling operations. Via the pivoting mounting of gripper unit 106 at frame 110 (via arm 109), and the axial movement means (not shown) gripper unit 106 is configured for movement in the x, y and z directions during rod transport.

Gripper unit 106 comprises a support frame 205 mounted to arm 109 and a movable sled 206 capable of shuttling back and forth with respect to frame 205 in the F and R directions during rod coupling and decoupling operations. In particular, gripper unit 106 comprises a pair of parallel shafts 207 that extend lengthwise in the x axis direction between a forward and rearward part of frame 205, a forward most side of frame 205 being positioned closest to the drill string 100 (and holder 108 and rotation unit 107). Sled 206 comprises a pair of sleeves 215 configured to slide over respectively each shaft 207 such that sled 206 is suspended in a 'floating' relationship with respect to frame 205. A first pair of rearward bias springs 209 are mounted at a rearward end of each shaft 207 and a corresponding pair of forward mounted bias springs 210 are positioned at a forward end of each shaft 207 axially either end of each sleeve 215. Accordingly, forward springs 210 provide biasing resistance to forward movement of sled 206 in direction F and rearward springs 209 provide resistance to axial movement of sled 206 in reverse direction R.

Gripper unit 106 further comprises a motion tracking sensor arrangement indicated generally by reference 208 mounted at a region of frame 205 and sled 206. Accordingly, a relative axial position of sled 206 (in the x axis direction) relative to frame 205 may be monitored by sensor unit 208.

Elongate beam 113 comprises a first end 216 rigidly mounted at alignment tool 104 and a second end 217 rigidly mounted a region of gripper frame 205. Beam 113 comprises a physical and mechanical configuration and in particular an outside diameter configured to allow alignment tool 104 to deflect laterally in the y and z plane during coupling of the rods in direction F. Alignment tool 104 comprises a pair of moveable jaws 204 pivotally mounted at a support frame 212 a region of which is coupled directly with beam end 216. An actuator 211 (typically a hydraulic, pneumatic or an electric motor) is mounted at frame 212 to drive pivoting displacement of jaws 204 in the y and z plane. In a 'closed' state jaws 204 define an internal coupling chamber 303 into which are received the end portions of the respective end rod 100 of the drill string and rod 115 to be added to the end of the drill string and carried with gripper unit 106.

Gripper unit 106 comprises a pair of opposed rod engagers in the form of gripper jaws 301, 302. Each jaw 301, 302 is capable of movement in a sideways lateral direction away from axis x corresponding generally to movement in the perpendicular y axis direction. Referring to FIG. 4, the two opposed jaws 301, 302 extend generally in a downward direction from sled 206 so as to represent an undercarriage of the gripper unit 106. Each jaw 300, 301 comprises a respective pair of rod engagers in the form of elongate rollers configured for frictional contact onto the external surface of rod 115. Each pair of rollers 400, 401 is aligned parallel with the longitudinal axis of rod 115 and axis x. A first roller 400 is positioned vertically above a second roller 401 and at an inward position of each jaw 301, 302 such that the four rollers 400, 401 form a quad assembly to surround rod 115 that is engaged and gripped between the opposed pair of rollers 400, 401.

Each jaw 301, 302 comprises a respective actuator 300 (being hydraulic, pneumatic or electric motors) mounted at a rearward end of each jaw 301, 302. Each actuator 300 is capable of providing rotational drive to at least one roller 400, 401, via gears 402 mounted on respective drive shafts (not shown) of each actuator 300, so as to impart rotation of rod 115 about its longitudinal axis. Additionally, a further actuator (not shown) is mounted at sled 206 and is configured to actuate the opening and closing of the respective jaws 301, 302 about rod 115.

Figure 5:
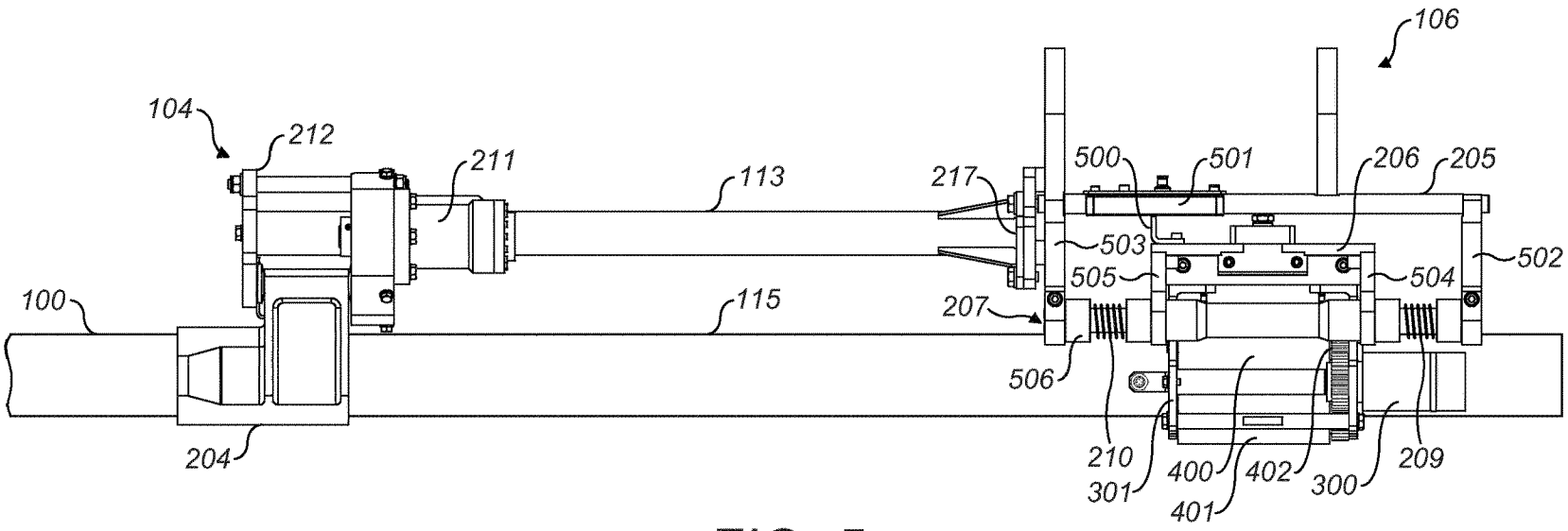
FIG. 5 is a side elevation view of the rod handling apparatus of FIG. 3 engaging a rod to be coupled to a drill string.

Motion sensor 208 is adapted to monitor the relative axial position (in the x axis direction) of sled 206 relative to frame 205. This is achieved via a first sensor part 500 mounted at a region of sled 206 and a second sensor part 501 mounted at frame 205. As rod 115 is gripped substantially rigidly by sled 206, any axial movement of rod 115 relative to frame 205 is determined by the length displacement sensor unit 500, 501. Such a sensor arrangement and its relative mounting position is useful both in the coupling and decoupling operations to provide feedback signals to the automated control unit (not shown) and to identify a correct coupling and decoupling of rods 100, 115. In particular, sensor arrangement 500, 501 is configured to determine the relative axial displacement of sled 206 having forward end 505 and rearward end 504 relative to frame 205 having forward end 503 and rearward end 502 referring to FIG. 5.

The function of alignment tool 104 is twofold. Firstly, a primary function is to provide guided coupling between rods 100 and 115 whilst a secondary function is to provide additional support for rod 115 during the transport between rack 103 and rig 101. As the collection of rod 115 from rack 103 typically involves the gripper unit 106 approaching rod 115 from above in the z axis direction, the alignment tool 104 must similarly comprise a jaw arrangement (corresponding to gripper jaws 301, 302) to allow rod 115 to be engaged by both units 104, 106 simultaneously. Accordingly, alignment tool jaw actuator 211 is synchronised with gripper jaw actuators 300 such that the opening and closing of the alignment jaws 204 occurs simultaneously with a corresponding opening and closing of the gripper jaws 301, 302.

Figure 6:
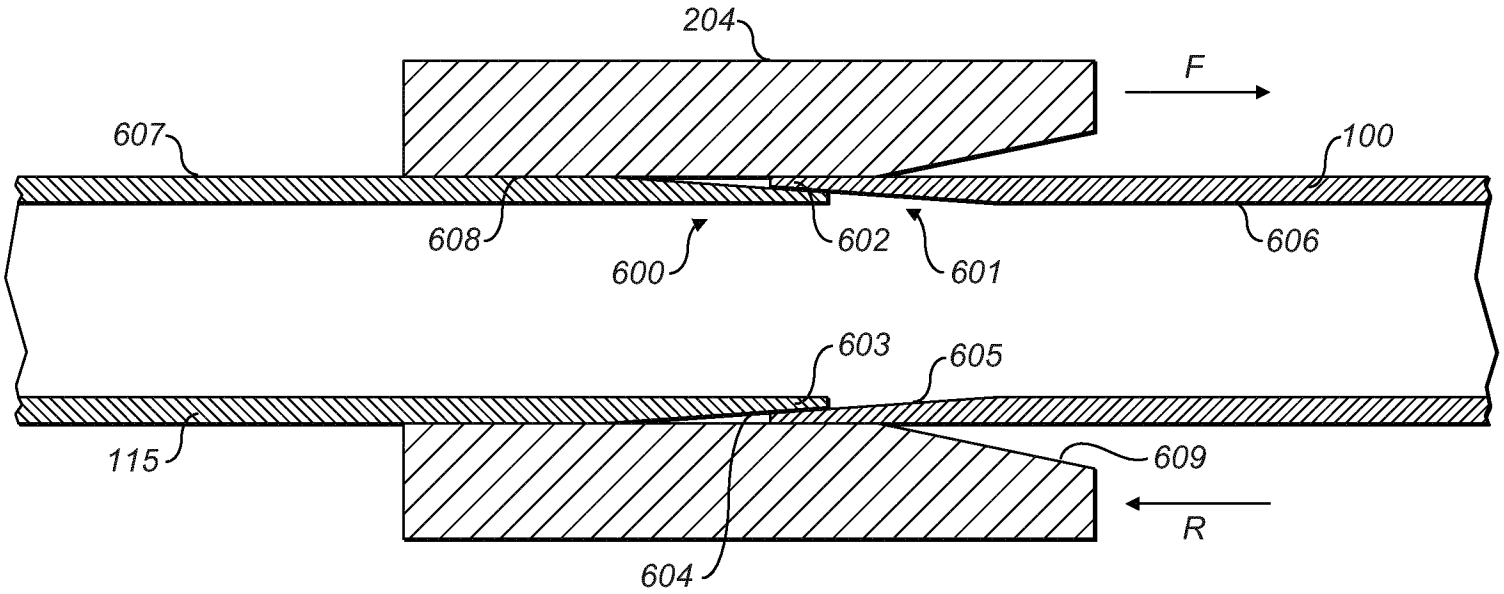
FIG. 6 is a schematic cross sectional view through a part of the jaw alignment tool of FIG. 5 coupling two rods together end-by-end.

Referring to FIG. 6, a rearward end region 601 of drill string rod 100 comprises a female threaded connection. In particular, screw threads 605 are formed at inward facing surface 606 at end region 601. Inward facing surface 606 at region 601 is tapered such that a wall thickness of rod 100 decreases towards end 602. A first forward most end region 600 of rod 115 also comprises a threaded connection. In particular, corresponding screw threads 604 are formed on the external surface 607 of rod 115 at region 600 to mate and cooperate with screw threads 605. Region 600 also comprises tapered walls such that the male end 603 is received within female end 602 as at least one of the rods 100, 115 is rotated about its longitudinal axis. According to the specific implementation, the coupling and decoupling in directions F and R of rods 100, 115 occurs within the jaws 204 of alignment tool 104.

The present rod handling apparatus is configured specifically to identify and detect the behaviour of rod 115 during loosening of threads 604, 605 and an associated disconnection of the threaded ends 602, 603. Accordingly, a 'thread-off' sequence will now be described referring to FIGS. 5 to 8. In particular, the axial displacement measurement and monitoring of rod 115 relative to rod 100 is achieved via the 'floating' suspended arrangement of sled 206 at frame 205 via the forward 210 and rearward 209 biasing components that are affective to resist respective forward F and rearward R displacement of sled 206 relative to frame 205.

Figure 7:
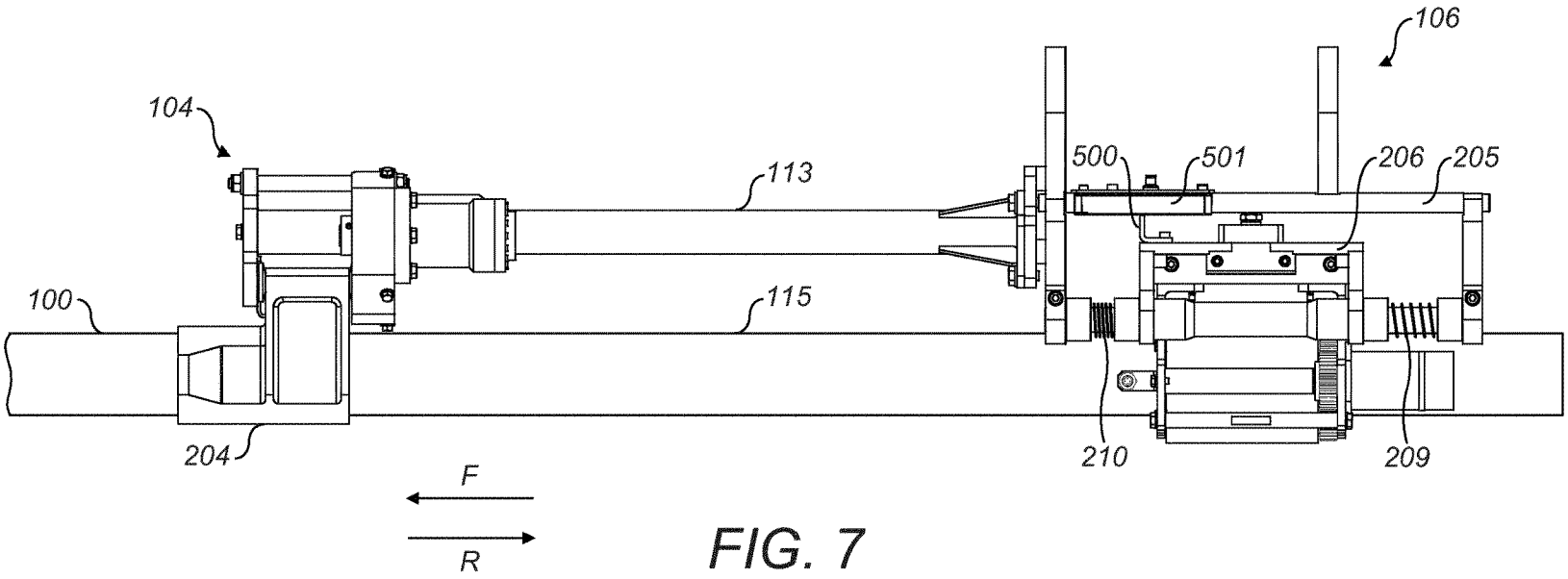
FIG. 7 is a further side elevation view of the rod handling apparatus of FIG. 5 with a sled part of the gripper unit displaced axially forward of a support frame.
Figure 8:
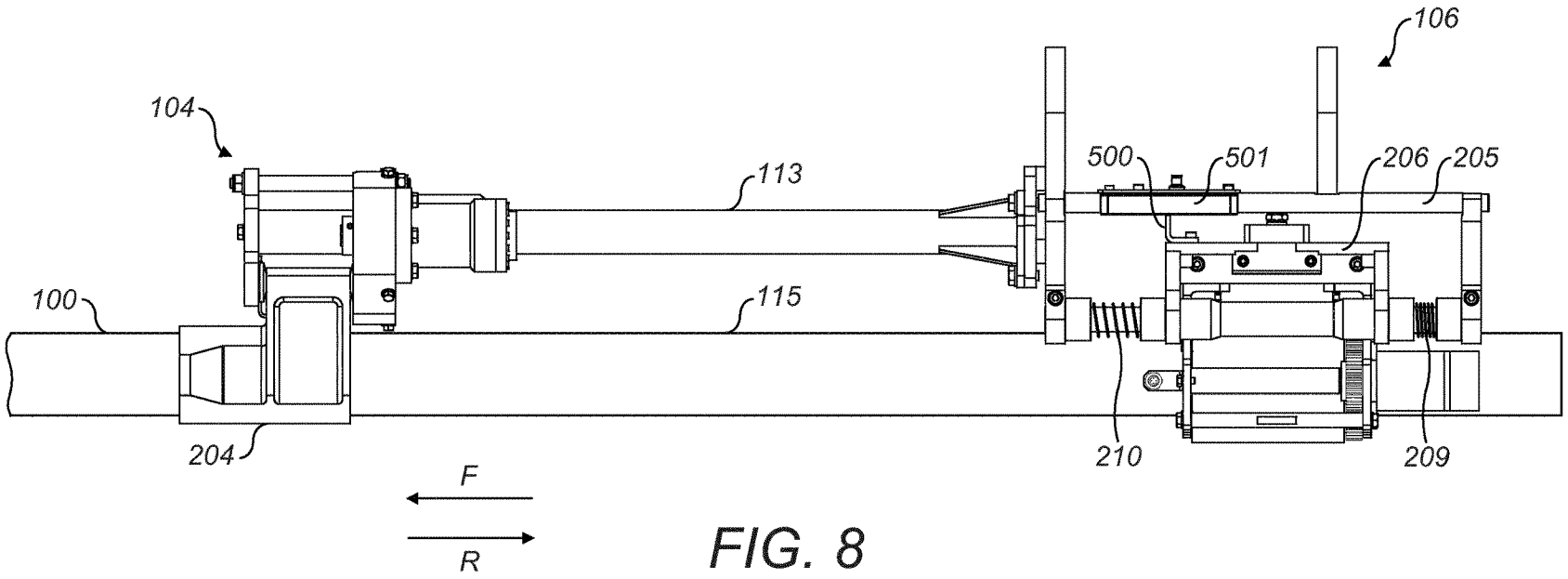
FIG. 8 is a further side elevation view of the rod handling apparatus of FIG. 5 with a sled part of the gripper unit displaced axially rearward of a support frame.

According to a preferred specific implementation of the present invention, decoupling of rod 115 from an rod 100 of the drill string is achieved as follows:

1. Rod holder 108 releases its grip on the rearward most rod 115 of the drill string. Rotation unit 107 retains its grip on rod 115 and pulls it along the x axis in direction R to pull the entire drill string in a rearward direction from the borehole. This procedure, being rod length dependent, runs until the next threaded joint is positioned between the rod holder 108 and the rotation unit 107. Preferably, a threaded connection is positioned at approximately 1 meter rearward of holder 108. Rotation unit 107 is mounted at frame 111 to be axially slidably such that its position relative to rod holder 108 is adjustable axially.
2. Rod holder 108 releases its grip around the second most rearward rod 100 in the string. Rotation unit 107 is initiated to provide a high torque force to the rearward most rod 100 so as to crack-open the threaded connection via approximately 0.5 to 1 revolutions. Accordingly, the male and female connections 600, 601 are still joined but loose.
3. The rotation unit 107 releases its grip on the rearward most rod 115 and is displaced axially forward in direction F so as to be positioned immediately behind holder 108 as shown in FIG. 1. Accordingly, rod 115 being the last rod in the string is now loosely threaded to the second most end rod 100 and is fully accessible for engagement by gripper unit 106.
4. Gripper unit 106 is initiated, either manually or automatically such that arm 109 moves into the position as shown in FIG. 1 over and about rod 115 with jaws 301, 302 open.
5. Gripper unit jaws 301, 302 and alignment tool jaws 204 are actuated to close about rod 115. It is to be noted that the configuration of the rod ends 600, 601 within the internal facing surface 608, 609 of alignment jaws 204 is not the requirement of the present 'thread-out' sequence. Optionally, the alignment tool jaws 204 may be positioned slightly rearward of the joint region 600, 601 so as to entirely cover rod 115 as it is extracted in direction R.
6. Gripper unit 106 is actuated to move in a rearward direction R by a relatively small distance (approximately 20 to 30 mm). Due to the relative dimensions of internal facing surface 609, 609 of alignment tool 104, jaws 204 slides over external facing surface 607 of rod 115. Gripper unit 106 is actuated in rearward direction R by the drive and actuator means (not shown) to move along frame 110. As gripper jaws 301, 302 are gripped about rod 115, sled 206 is maintained in stationary position as rod 115 is only partially decoupled from rod 100 as shown in FIG. 6. Accordingly, this results in compression of the two forward most springs 210 as illustrated in FIG. 7.
7. At least one of the rollers 400, 401 are rotated to rotate rod 115 in a left hand direction to 'thread-off' rod 115 from rod 100. Accordingly, forward springs 210 start to decompress and as the thread length is approximately 35 to 50 mm the springs pass their neutral positions. Furthermore, the pair of rearward springs 209 start to compress. The initial compression described in step 6 is undertaken to avoid excessive compression of the rearward spring 209 as rod 115 is unthreaded from rod 100 via gripper unit 106. By way of example, the left hand rotation of rod 115 acts for 5 seconds (being rod size and rotational speed dependent). If gripper unit 106 has an adequate grip about rod 115, 5 seconds is an adequate time for completely threading-off rod 115.
8. Accordingly, rod 115 should now be free and axial translation of gripper unit 106 in a rearward direction R is now initiated via the drive movement means (not shown) at frame 110. In this sequence, longitudinal direction sensors 500, 501 track the relative position of rod 115 so as to identify any relative forward motion in direction F that would recompress the forward springs 210. This would occur if rod 115 is not completely decoupled from rod 100 due for example to rollers 400, 401 failing to rotate/thread-off the rod 115. In this situation, two more attempts could be programmed to achieve complete thread-off by repeating the 5 seconds left hand rotation and the retraction steps. If all attempts fail, the automation will terminate. If any reattempts are successful, rod 115 will be transported to rack 103 via activity actuation of arm 109.

According to a further specific implementation, as an alternative to step 7 whilst rollers 400, 401 rotate rod 115 in the left hand direction, the entire gripper unit 106 could simultaneously be translated rearward in direction R along frame 110. Accordingly, this will preserve, to a large extent, compression of the forward springs 210 as illustrated in FIG. 7. When rod 115 breaks free, it will suddenly 'jump' due to the compression at springs 210 and the symmetrical floating suspension of sled 206 at frame 205. This 'jumping' motion is tracked by length sensors 500, 501 to indicate decoupling of threaded ends 600, 601.

According to a further specific implementation, and starting from step 7, if the 5 second time limit for left hand rotation is omitted such that left rotation is unlimited, the thread end 602, 603 will bounce against one another after the rods 115 and 100 are entirely decoupled, creating an axial cam motion pattern. This repeating motion pattern is tracked by length sensors 500, 501 to trigger rod extraction via pivoting movement of arm 109 as described above.

According to a further specific implementation and as an alternative to step 6, the left hand rotation is initiated. This motion will immediately start to compress rearward spring 209 with the lengthwise movement of sled 206 tracked by sensors 500, 501. At this stage, the sensors 500, 501 are configured to allow small lengthwise changes such that when a linear motion is detected that exceeds the limit, sensor 500, 501 will then control a rearward moving translation of the gripper unit 106 along frame 110 as the sled 206 is maintained at a substantially constant position with respect to gripper frame 205. When rod 115 is released, the direction of motion will change to again a bouncing cam motion. This direction change together with a magnitude control triggers a rod extraction and a decoupling of ends 600, 601.

As will be appreciated, sensor arrangement 500, 501 may comprise any form. For example, sensors 500, 501 may comprise a measurement roller extending between anyone of frame 205, sled 206 and rod 115. According to further embodiments, corresponding sensors may be positioned at shafts 207 and/or shaft bushings 506 positioned either side of springs 210. 209. The sensors may include optical sensors for example laser, camera and light based components. It is also possible to use hydraulic or pneumatic means for biasing sled 206 relative to frame 205. In such instances, a pressure change in the pressure medium (gas or liquid) may be used as an indication of axial movement. Optionally, hydraulic or pneumatic biasing means may be provided between sled 206 and frame 205 with the relative pressure change being determined as indicated above. A further embodiment may comprise an accelerometer to measure the acceleration of rod 115 as the rod ends 600, 601 slip over one another. This acceleration may be used as an indication of the lengthwise displacement. A yet further embodiment may comprise a sound sensor which determines the sound produced when threads 604, 605 slip over one another and the threads strike against one another and/or are released during disengagement.

The invention claimed is:

1. A method of disconnecting an end rod from a drill string coupled together by a threaded connection, the method comprising:

initially rotating the end rod relative to a remaining drill string in a disengagement direction of the threaded connection to partially disconnect the end rod from the drill string;

moving a gripper unit into engagement with the partially disconnected end rod, the gripper unit having a frame and a sled suspended at the frame via at least one runner, the sled and the at least one runner being aligned parallel to a longitudinal axis of the rod, the sled being arranged to slide axially relative to the frame along the at least one runner, the sled having rod engagers aligned parallel to a longitudinal axis of the rod to engage and hold the end rod;

moving the rod engagers to engage and hold the partially disconnected end rod;

axially biasing the sled at the frame via at least one bias component arranged to move parallel with the longitudinal axis to provide resistance to axially forward or rearward movement of the sled relative to the frame along the at least one runner and parallel to the rod;

further rotating the end rod in the disengagement direction via the rod engagers to further decouple the end rod from the drill string;

monitoring a relative axial position of the sled at the frame using at least one sensor to determine a decoupling of the threaded connection and a decoupling of the rod from the drill string; and moving the frame axially rearwardly away from the drill string whilst the sled is substantially stationary and in engagement with the end rod to bias the frame against the sled prior to the step of further rotating the end rod; and following the step of further rotating the end rod moving the frame axially rearward from the drill string whilst monitoring the axial position of the sled at the frame.

2. The method as claimed in claim 1, further comprising moving the frame axially rearwardly away from the drill string whilst the sled is substantially stationary and in engagement with the end rod to bias the frame against the sled prior to the step of further rotating the end rod; and during the step of further rotating the end rod moving the frame axially rearwardly from the drill string whilst monitoring the axial position of the sled at the frame.

3. The method as claimed in claim 1, further comprising moving the frame axially rearwardly away from the drill string whilst the sled is substantially stationary and in engagement with the end rod to bias the frame against the sled prior to the step of further rotating the end rod, wherein the step of monitoring the relative axial position of the sled at the frame comprises identifying an axial movement direction change of the sled relative to the frame corresponding to a change in the axial movement direction of the end rod relative to the drill string being associated with a decoupling of the threaded connection.

4. The method as claimed in claim 1, wherein the step of further rotating the end rod includes maintaining the axial position of the frame to bias the sled against the frame as the end rod is moved axially rearward from the drill string, wherein the step of monitoring the relative axial position of the sled and frame includes identifying an axial movement direction change of the sled relative to the frame corresponding to a change in the axial movement direction of the end rod relative to the drill string being associated with a decoupling of the threaded connection.

5. The method as claimed in claim 1, further comprising biasing the sled at the frame using at least one first bias component resistant to axial forward movement of the sled relative to the frame and at least one second bias component resistant to axial rearward movement of the sled relative to the frame, the axial forward and rearward movement being relative to the drill string.

6. The method as claimed in claim 1, further comprising gripping and holding the end rod at the sled via rod engaging jaws that close around the end rod.

7. The method as claimed in claim 1, wherein the step of further rotating the end rod includes driving a rotation of the end rod using at least one rotatable member provided at the rod engagers positioned in frictional engagement with the end rod.

8. The method as claimed in claim 1, wherein the step of initially rotating the end rod includes gripping the drill string with a rod holder of the drill rig axially forward of the threaded connection; and rotating the end rod at a region axially rearward of the threaded connection using a rotation unit of the drill rig.

9. The method as claimed in claim 1, wherein the step of monitoring the relative axial position of the sled at the frame includes monitoring and/or detecting an axial movement between a region of the frame and a region of the sled.

10. The method as claimed in claim 1, wherein the sensor is mounted at the sled or the frame and is configured to monitor movement of a region of the alternate frame or sled.

11. The method as claimed in claim 1, wherein the sensor is selected from the group of an optical sensor; a laser; a camera; a pressure sensor configured to identify changes in hydraulic or pneumatic pressures associated with hydraulic or pneumatic means associated with the frame and/or sled; an accelerometer; a sound sensor; an electronic based sensor; an electric based sensor; and a magnetic based sensor.

12. A drill rod handling apparatus cooperative with a drill rig to transport a rod to and from a drill string of the drill rig, the apparatus comprising:

a gripper frame;

a sled mounted at the frame via at least one runner, the sled and the at least one runner being aligned parallel to a longitudinal axis of the rod and arranged to move relative to the frame in an axial direction of the rod to be transported by the apparatus;

at least one first bias component positioned to bias the sled to be resistant to an axial forward movement of the sled along the at least one runner;

at least one second bias component positioned to bias the sled to be resistant to an axially rearward movement of the sled along the at least one runner;

rod engagers mounted at the sled to engage and hold the rod to be transported; and a sensor positioned at the sled or frame configured to monitor a relative axial position of the sled relative to the frame.

13. The apparatus as claimed in claim 12, further comprising two runners positioned parallel to one another; and a pair of first bias components, each first bias component being mounted respectively towards a first end of each runner and a pair of second bias components mounted respectively towards a second end of each runner.

* * * * *